US007108042B2

(12) United States Patent
Koch

(10) Patent No.: US 7,108,042 B2
(45) **Date of Patent: *Sep. 19, 2006**

(54) ALUMINUM DIECASTING ALLOY

(75) Inventor: Hubert Koch, Rheinfelden (DE)

(73) Assignee: Aluminum Rheinfelden GmbH, (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/170,051

(22) Filed: Jun. 28, 2005

(65) Prior Publication Data

US 2006/0011321 A1 Jan. 19, 2006

(30) Foreign Application Priority Data

Jun. 29, 2004 (CH) ..... 1091/04

(51) Int. Cl.
*B22D 17/00* (2006.01)
*C22C 21/04* (2006.01)

(52) U.S. Cl. ..... 164/113; 164/55.1; 164/57.1; 420/549; 420/553

(58) Field of Classification Search ..... 164/113, 164/55.1, 57.1; 420/549, 553
See application file for complete search history.

(56) References Cited

U.S. PATENT DOCUMENTS 5,250,125 A * 10/1993 Koch et al. ..... 148/549
6,325,462 B1 * 12/2001 Hummel et al. ..... 301/65
6,364,970 B1 * 4/2002 Hielscher et al. ..... 148/440
6,824,737 B1 * 11/2004 Koch ..... 420/549

FOREIGN PATENT DOCUMENTS

| | | | |
|---|---|---|---|
| EP | 601972 | * | 6/1994 |
| EP | 1331281 | * | 7/2003 |
| WO | 03052151 | * | 6/2003 |

* cited by examiner

*Primary Examiner*—Kevin Kerns
*Assistant Examiner*—I.-H. Lin
(74) *Attorney, Agent, or Firm*—Bachman & LaPointe

(57) ABSTRACT

An aluminum alloy suitable for diecasting of components with high elongation in the cast state contains, as well as aluminum and unavoidable impurities, 8.0 to 11.5 w. % silicon, 0.3 to 0.8 w. % manganese, 0.08 to 0.4 w. % magnesium, max 0.4 w. % iron, max 0.1 w. % copper, max 0.1 w. % zinc, max 0.15 w. % titanium and 0.05 to 0.5 w. % molybdenum. Optionally, the alloy also contains 0.05 to 0.3 w. % zirconium, 30 to 300 ppm strontium or 5 to 30 ppm sodium and/or 1 to 30 ppm calcium for permanent refinement and for grain refinement gallium phosphide and/or indium phosphide in a quantity corresponding to 1 to 250 ppm phosphorus and/or titanium and boron added by way of an aluminum master alloy with 1 to 2 w. % Ti and 1 to 2 w. % B.

11 Claims, No Drawings

ALUMINUM DIECASTING ALLOY

BACKGROUND OF THE INVENTION (1) Field of the Invention

The invention concerns an aluminum alloy for diecasting of components with high elongation in the cast state.

(2) Prior Art

Diecasting technology has today developed so far that it is possible to produce components with high quality standards. The quality of a diecasting however depends not only on the machine setting and the process selected but to a great extent also on the chemical composition and the structure of the aluminum alloy used. The latter two parameters are known to influence the castability, the feed behavior (G. Schindelbauer, J. Czikel "Mould filling capacity and volume deficit of conventional aluminum diecasting alloys", Giessereiforschung 42, 1990, p. 88/89), the mechanical properties and—particularly important in diecasting—the life of the casting tools (L. A. Norström, B. Klarenfjord, M. Svenson "General Aspects on Wash-out Mechanism in Aluminium Diecasting Dies" 17th International NADCA Diecasting Congress 1993, Cleveland, Ohio).

In the past little attention has been paid to the development of aluminum alloys which are particularly suited for diecasting of high quality components. Manufacturers in the car industry are now increasingly required to produce e.g. weldable components with high ductility in the diecasting process, since diecasting is the most economic production method for high quantities.

The refinement of the diecasting technology now allows the production of weldable components of high quality. This has expanded the area of application for diecastings to include chassis components.

Ductility is increasingly important, in particular in components of complex design.

In order to achieve the required mechanical properties, in particular a high elongation to fracture, the diecastings must usually be subjected to heat treatment. This heat treatment is necessary for forming the casting phase and hence achieving ductile fracture behavior. Heat treatment usually means solution annealing at temperatures just below the solidus temperature with subsequent quenching in water or another medium to temperatures <100° C. The material treated in this way now has a low elongation limit and tensile strength. In order to raise these properties to the required value, artificial ageing is then performed. This can also be process-induced e.g. by thermal shock on painting or stress-relief annealing of a complete assembly.

As diecastings are cast close to the final dimensions, they usually have a complex geometry with thin walls. During the solution annealing, and in particular the quenching process, distortion must be expected which can require retouching e.g. by straightening the casting or, in the worst case, rejection. Solution annealing also entails additional costs, and the efficiency of this production method could be substantially increased if alloys were available which fulfilled the required properties without heat treatment.

An AlSi alloy with good mechanical values in the casting state is known from EP-A-0 687 742. Also for example EP-A-0 911 420 discloses alloys of type AlMg which in the casting state have a very high ductility, but with complex form design however tend to hot or cold cracking and are therefore unsuitable. A further disadvantage of ductile diecastings is their slow ageing in the cast state which can lead to a temporary change in mechanical properties—including a loss of elongation. This behavior is tolerated in many applications as the property limits are not exceeded, but cannot be tolerated in some applications and can only be excluded by targeted heat treatment.

SUMMARY OF THE INVENTION

The invention is based on the object of preparing an aluminum alloy which is suitable for diecasting which is easy to cast, has a high elongation in the cast state and after casting ages no further. In addition the alloy should be easily weldable and flangeable, able to be riveted and have good corrosion resistance.

According to the invention the object is achieved by an aluminum alloy with 8.0 to 11.5 w. % silicon
0.3 to 0.8 w. % manganese
max 0.08 to 0.4 w. % magnesium
max 0.4 w. % iron
max 0.1 w. % copper
max 0.1 w. % zinc
max 0.15 w. % titanium
0.05 to 0.5 w. % molybdenum
optionally also
0.05 to 0.3 w. % zirconium
30 to 300 ppm strontium or 5 to 30 ppm sodium and/or 1 to 30 ppm calcium for permanent refinement
gallium phosphide and/or indium phosphide in a quantity corresponding to 1 to 250 ppm phosphorus for grain refinement
titanium and boron added by way of an aluminum master alloy with 1 to 2 w. % Ti and 1 to 2 w. % B for grain refinement,
and as the remainder aluminum and unavoidable impurities.

DETAILED DESCRIPTION OF THE PREFERRED EMBODIMENT(S)

With the alloy composition according to the invention, for diecastings in the cast state a high elongation can be achieved with good values for the yield strength and tensile strength, so that the alloy is suitable in particular for the production of safety components in car manufacture. Surprisingly, it has been found that by the addition of molybdenum the elongation can be increased substantially without losses in the other mechanical properties. The desired effect can be achieved with the addition of 0.05 to 0.5 w. % Mo, the preferred behavior level is 0.08 to 0.25 w. % Mo.

With the combined addition of molybdenum and 0.05 to 0.3 w. % Zr, the elongation can be improved even further. The preferred content is 0.10 to 0.18 w. % Zr.

The relatively high proportion of eutectic silicon is refined by strontium. In contrast to granular diecasting alloys with high contaminant levels, the alloy according to the invention also has advantages with regard to fatigue strength. The fracture toughness is higher because of the very low mixed crystals present and the refined eutectic. The strontium content is preferably between 50 and 150 ppm and in general should not fall below 50 ppm otherwise the casting behavior can deteriorate. Instead of strontium, sodium and/or calcium can be added.

The preferred silicon content is 8.0 to 10.0 w. % Si.

By restricting the magnesium content to preferably 0.08 to 0.25 w. % Mg, the eutectic structure is not coarsened and the alloy has only a insignificant age-hardening potential which contributes to a high elongation.

Due to the proportion of manganese, adhesion in the mould is avoided and good mould removal properties guaranteed. The manganese content gives the casting a high structural strength at high temperature so that on removal from the mould, very little or no distortion is expected.

The iron content is restricted to preferably max 0.25 w. % Fe.

With stabilization annealing for 1 to 2 hours in a temperature range of around 280 to 320° C., very high elongation values can be achieved.

The alloy according to the invention is preferably produced as a horizontal diecasting pig. Thus without costly melt cleaning, a diecasting alloy with low oxide contamination can be melted: an important condition for achieving high elongation values in the diecasting.

On melting, any contamination of the melt, in particular by copper or iron, must be avoided. The permanently refined AlSi alloy according to the invention is preferably cleaned by flushing gas treatment with inert gases by means of impellers.

Preferably, grain refinement is performed in the alloy according to the invention. For this gallium phosphide and/or indium phosphide can be added to the alloy in a quantity corresponding to 1 to 250 ppm, preferably 1 to 30 ppm phosphorus. Alternatively or additionally the alloy can contain titanium and boron for grain refinement, where the titanium and boron are added by way of a master alloy with 1 to 2 w. % Ti and 1 to 2 w. % B, remainder aluminum. Preferably, the aluminum master alloy contains 1.3 to 1.8 w. % Ti and 1.3 to 1.8 w. % B and has a Ti/B weight ratio of around 0.8 to 1.2. The content of the master alloy in the alloy according to the invention is preferably set at 0.05 to 0.5 w. %.

The aluminum alloy according to the invention is particularly suitable for the production of safety components in the diecasting process.

What is claimed is:

1. Aluminum alloy for diecasting of components with high elongation in the cast state with 8.0 to 11.5 w. % silicon
0.3 to 0.8 w. % manganese
0.08 to 0.4 w. % magnesium
max 0.4 w. % iron
max 0.1 w. % copper
max 0.1 w. % zinc
max 0.15 w. % titanium
0.05 to 0.5 w. % molybdenum,
optionally also
0.05 to 0.3 w. % zirconium
30 to 300 ppm strontium or 5 to 30 ppm sodium and/or 1 to 30 ppm calcium for permanent refinement
gallium phosphide and/or indium phosphide in a quantity corresponding to 1 to 250 ppm phosphorus for grain refinement
titanium and boron added by way of an aluminum master alloy with 1 to 2 w. % Ti and 1 to 2 w. % B for grain refinement,
and as the remainder aluminum and unavoidable impurities.

2. Aluminum alloy according to claim 1, wherein said strontium is present in an amount from 50 to 150 ppm.

3. Aluminum alloy according to claim 1, wherein said silicon is present in an amount from 8.0 to 10.0 w. %.

4. Aluminum alloy according to claim 1, wherein said magnesium is present in an amount from 0.08 to 0.25 w. %.

5. Aluminum alloy according to claim 1, wherein said iron is present in an amount of max 0.25 w. %.

6. Aluminum alloy according to claim 1, wherein said zirconium is present in an amount from 0.10 to 0.18 w. %.

7. Aluminum alloy according to claim 1, wherein said molybdenum is present in an amount from 0.08 to 0.25 w. %.

8. Aluminum alloy according to claim 1, wherein said gallium phosphide and/or indium phosphide is present in a quantity corresponding to 1 to 30 ppm phosphorus.

9. Aluminum alloy according to claim 1, wherein said aluminum master alloy has from 1.3 to 1.8 w. % titanium and from 1.3 to 1.8 w. % boron and a titanium/boron weight ratio between 0.8 and 1.2.

10. Aluminum alloy according to claim 9, wherein said aluminum master alloy is present in an amount from 0.05 to 0.5 w. %.

11. A process of manufacturing safety components for a car comprising the steps of:

providing an aluminum alloy consisting essentially of from 8.0 to 11.5 wt % silicon, from 0.3 to 0.8 wt % manganese, from 0.08 to 0.4 wt % magnesium, up to 0.4 wt % iron; up to 0.1 wt % copper, up to 0.1 wt % zinc, up to 0.15 wt % titanium, from 0.05 to 0.5 wt % molybdenum, optionally also from 0.05 to 0.3 wt % zirconium, 30 to 300 ppm strontium or 5 to 30 ppm sodium, and/or 1 to 30 ppm calcium, gallium phosphide and/or indium phosphide in a quantity corresponding to 1 to 250 ppm phosphorus, titanium and boron added by way of an aluminum master alloy with 1 to 2 wt % titanium and 1 to 2 wt % boron, and the remainder being aluminum and unavoidable impurities; and manufacturing said safety components by diecasting said safety components from the aluminum alloy.

* * * * *